US005582079A

United States Patent [19]

Matsumura et al.

[11] Patent Number: 5,582,079

[45] Date of Patent: Dec. 10, 1996

[54] BOLT TIGHTENING DEVICE

[75] Inventors: Shozo Matsumura, Toyonaka; Sueharu Yasutomi, Osaka, both of Japan

[73] Assignee: Maeda Metal Industries, Inc., Osaka, Japan

[21] Appl. No.: 507,641

[22] Filed: Jul. 25, 1995

[30] Foreign Application Priority Data

Jul. 26, 1994 [JP] Japan ..... 6-173036

[51] Int. Cl.[6] ..... B25B 21/00

[52] U.S. Cl. ..... 81/56; 81/57.14

[58] Field of Search ..... 81/55–57, 57.11–57.14, 81/57.22, 57.29, 57.3, 57.31, 57.32, 57.36

[56] References Cited

U.S. PATENT DOCUMENTS 5,161,437 11/1992 Yasutomi et al. ..... 81/56 X 5,238,461 8/1993 Gotman ..... 81/56 X 5,490,439 2/1996 Matsumura et al. ..... 81/56 X

*Primary Examiner*—D. S. Meislin

*Attorney, Agent, or Firm*—Pravel, Hewitt, Kimball & Krieger

[57] ABSTRACT

A bolt tightening device having an inner socket and an outer socket arranged coaxially with each other and coupled to a motor by planetary gear mechanisms for tightening a reaction-bearing bolt with a nut thereon by engaging the nut in the outer socket and a tip at one end of the bolt in the inner socket. The inner and outer sockets are coupled respectively to two output shafts of the gear mechanism in the terminal stage which are rotatable in directions opposite to each other. The terminal gear mechanism has an axis displaced from the axes of the other gear mechanisms in parallel thereto, and has two input shafts coupled to two output shafts of the other gear mechanisms by way of first and second idle gears, respectively. This construction reduces the axial thickness of the socket side of the device, rendering the device easy to use.

4 Claims, 4 Drawing Sheets

BOLT TIGHTENING DEVICE

FIELD OF THE INVENTION

The present invention relates to a bolt tightening device for use in tightening up reaction-bearing bolts which are provided at one end of the threaded shank with a tip adapted to bear the reaction of tightening a nut screwed on the threaded shank.

BACKGROUND ART

FIG. 4 shows such a bolt tightening device which comprises planetary gear mechanisms 3, 4, 5 arranged inside a housing 10, an outer socket 7 coupled to one of two output shafts of the gear mechanism 5 in the terminal stage which are rotatable in directions opposite to each other, an inner socket 71 coupled to the other output shaft, and a motor 2 coupled to the input shaft of the first gear mechanism 3.

When the tightening device is to be used for a reaction-bearing bolt 8 passed through a plurality of members, such as a beam 9 and a channel member 91, a nut 85 is screwed on the bolt 8, and the device is operated with the outer socket 7 engaged with the nut 85 and the inner socket 71 with the tip 83. The nut can be tightened up with the tip 83 sustaining or bearing the reaction of tightening the nut.

Two types of reaction-bearing bolts 8 are available; one wherein the tip 83 merely bears a reaction, and the other wherein a groove 84 is formed between the threaded shank 81 and the tip 83, such that the tip 83 is twisted off from the grooved portion when subjected to a torque exceeding a predetermined value. For tightening upbolts of the former type, the tightening device has a torque limiter incorporated therein.

In either case, the tightening device has two sockets 7, 71 and a plurality of planetary gear mechanisms 3, 4, 5 which are arranged coaxilly, so that the housing 10 for holding these components has an increased length axially of the sockets 7, 71.

This entails the problem that when one side wall 91*a* of the channel member 91 which has a small groove width is to be fastened to the beam 9 with bolts, it is impossible to insert the tightening device into the groove of the channel member 91 for tightening the bolts.

Accordingly, the present applicants have made attempts to realize a tightening device having a great output and yet usable in narrow spaces by combining the device of FIG. 4 with a bolt tightening auxiliary tool 100 previously proposed by the applicants (see FIG. 3).

The auxiliary tool 100 of FIG. 3 comprises two coaxial input shafts 102, 101, two coaxial output shafts 103, 104 connected to an outer socket 7 and an inner socket 71 and displaced from the shafts 102, 101 in parallel thereto, and idle gears 61, 61 and 6, 6 interposed between the shafts 102, 103 and between the shafts 101,104, respectively. This arrangement reduces the thickness of the casing 105 axially of the sockets.

The auxiliary tool 100 is connected to two output shafts 201, 202 of a planetary gear mechanism 200, which has one input shaft 203.

A manual handle 14 is engaged with the shaft 203 of the mechanism and rotated, whereby bolts are tightened up.

In the case where three planetary gear mechanisms are connected to the auxiliary tool 100 of FIG. 3 coaxially therewith in place of the planetary gear mechanism 200, and two output shafts of the gear mechanism in the terminal stage are coupled to the inputs shafts 103, 104 of the outer socket 7 and the inner socket 71 by way of the idle gears 61, 61 and 6, 6 serving as two rotation transmitting systems, torques greatly reduced in speed and grealy increased in magnitude by the three gear mechanisms need to be transmitted by the idle gears 61, 6. The idle gears 61, 6 and the gears on the input shafts 103, 104 must therefore be made greater individually, consequently giving the casing 105 a larger thickness than is intended axially of the sockets.

An object of the present invention is to provide a bolt tightening device wherein a plurality of planetary gear mechanisms are arranged ingeniously to reduce the axial thickness of the device at its socket side and overcome the foregoing problem.

SUMMARY OF THE INVENTION

The present invention provides a bolt tightening device having an inner socket and an outer socket arranged coaxially with each other and coupled to a motor by a plurality of planetary gear mechanisms for tightening a reaction-bearing bolt with a nut screwed thereon by engaging the nut in the outer socket and a tip at one end of the bolt in the inner socket, the device being characterized in that the inner socket and the outer socket are coupled respectively to two output shafts of the planetary gear mechanism in the terminal stage rotatable in directions opposite to each other, the terminal planetary gear mechanism having an axis displaced from the axes of the other planetary gear mechanisms in parallel thereto, the terminal planetary gear mechanism having two input shafts coupled to two output shafts of the other planetary gear mechanisms by way of first and second idle gears respectively.

Planetary gear mechanisms are singly capable of readily multiplying a torque about four times, so that the idle gear used in the invention can be small-sized, i.e., can be reduced in width to ¼ of the idle gear which is designed to transmit the great output of the terminal planetary gear mechanism to the socket side if these idle gears are the same in the number of teeth and module.

Further since the gear of the terminal planetary gear mechanism at the socket side which is in mesh with the idle gear needs only to be so shaped as to mesh with the idle gear which is thus reduced in width, the terminal planetary gear mechanism itself is not very great in the axial direction.

Accordingly, the socket side of the bolt tightening device can be diminished in axial dimension, permitting its sockets to be inserted even into the narrow groove of the channel member for tightening up the bolts on the channel member.

A reduction in the size of the idle gear also diminishes the shaft supporting this gear and the portion supporting the shaft, reducing the weight of the overall tightening device and enabling the user to achieve an improved work efficiency.

DETAILED DESCRIPTION OF EMBODIMENT

Figure 1:
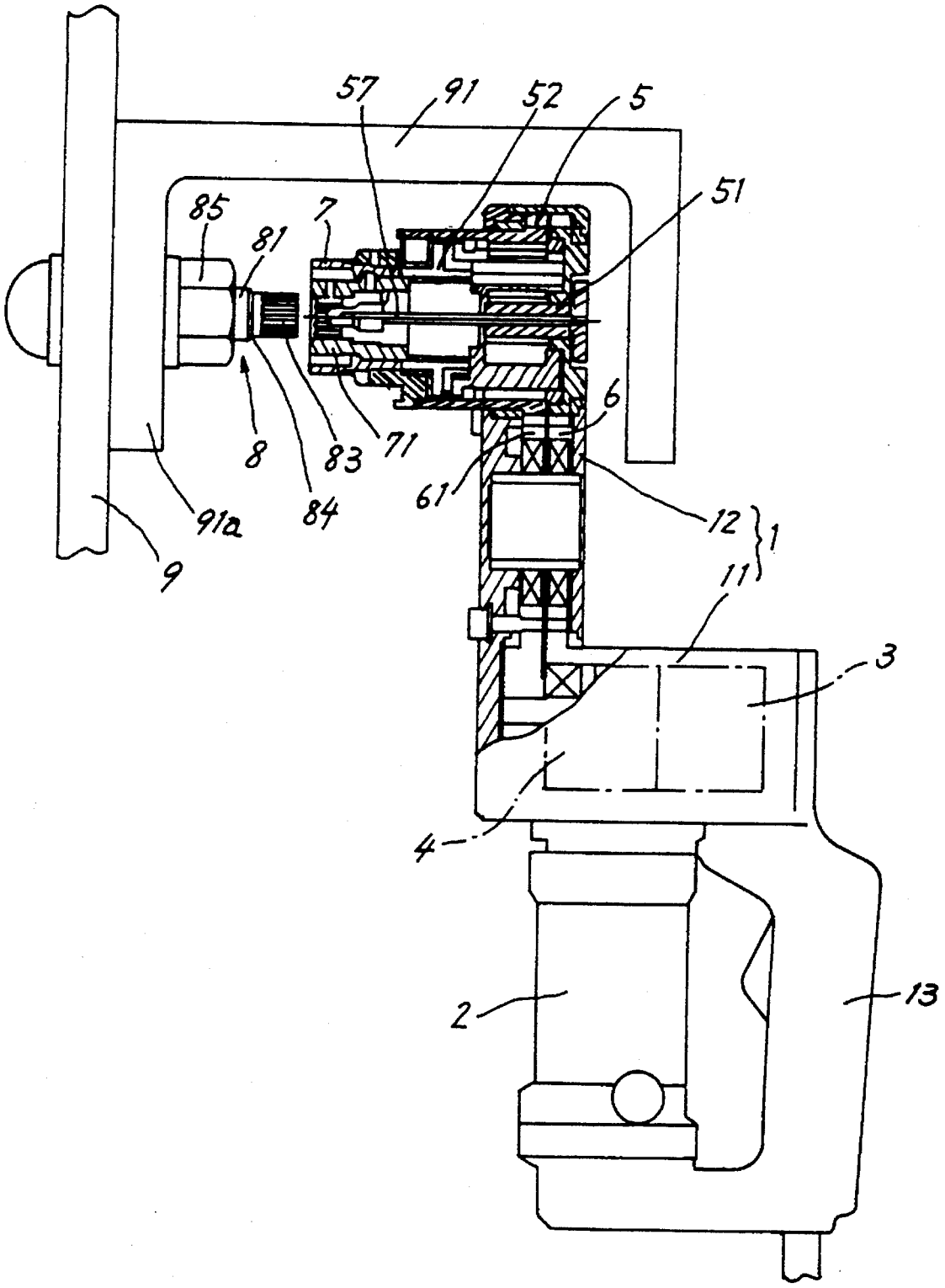
FIG. 1 is a diagram for illustrating a bolt tightening device of the invention in use.

With reference to FIG. 1, the illustrated tightening device has a housing 1 comprising a tubular housing base portion 11 and a housing extension 12 projecting from one end of the base portion 11 at right angle therewith, and generally L-shaped. The housing base portion 11 is provided with a handle 13 and a motor 2.

Arranged inside the housing base portion 11 are a first planetary gear mechanism 3, and a second planetary gear mechanism 4 coaxial with the mechanism 3.

A third planetary gear mechanism 5 is partly accommodated in the distal end of the housing extension 12. An outer socket 7 and an inner socket 71 are coupled respectively to two output shafts of the third mechanism 5.

The second gear mechanism 4 is coupled to the third gear mechanism 5 by idle gears 6, 61 arranged in an intermediate portion of the extension 12 and freely rotatable coaxially with, but independently of, each other.

Figure 2:
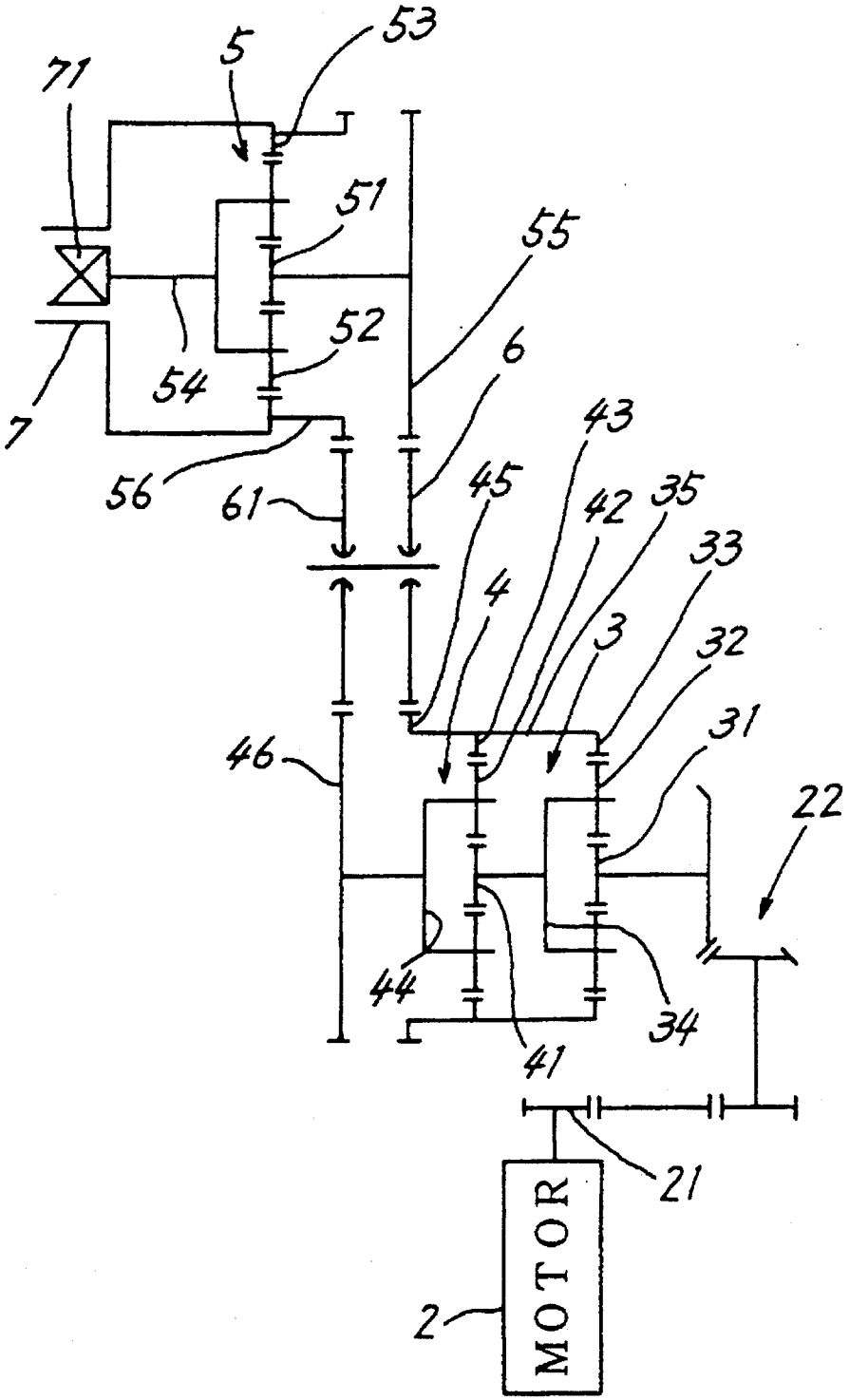
FIG. 2 is a diagram generally illustrating an arrangement of gears in mesh.
Figure 3:
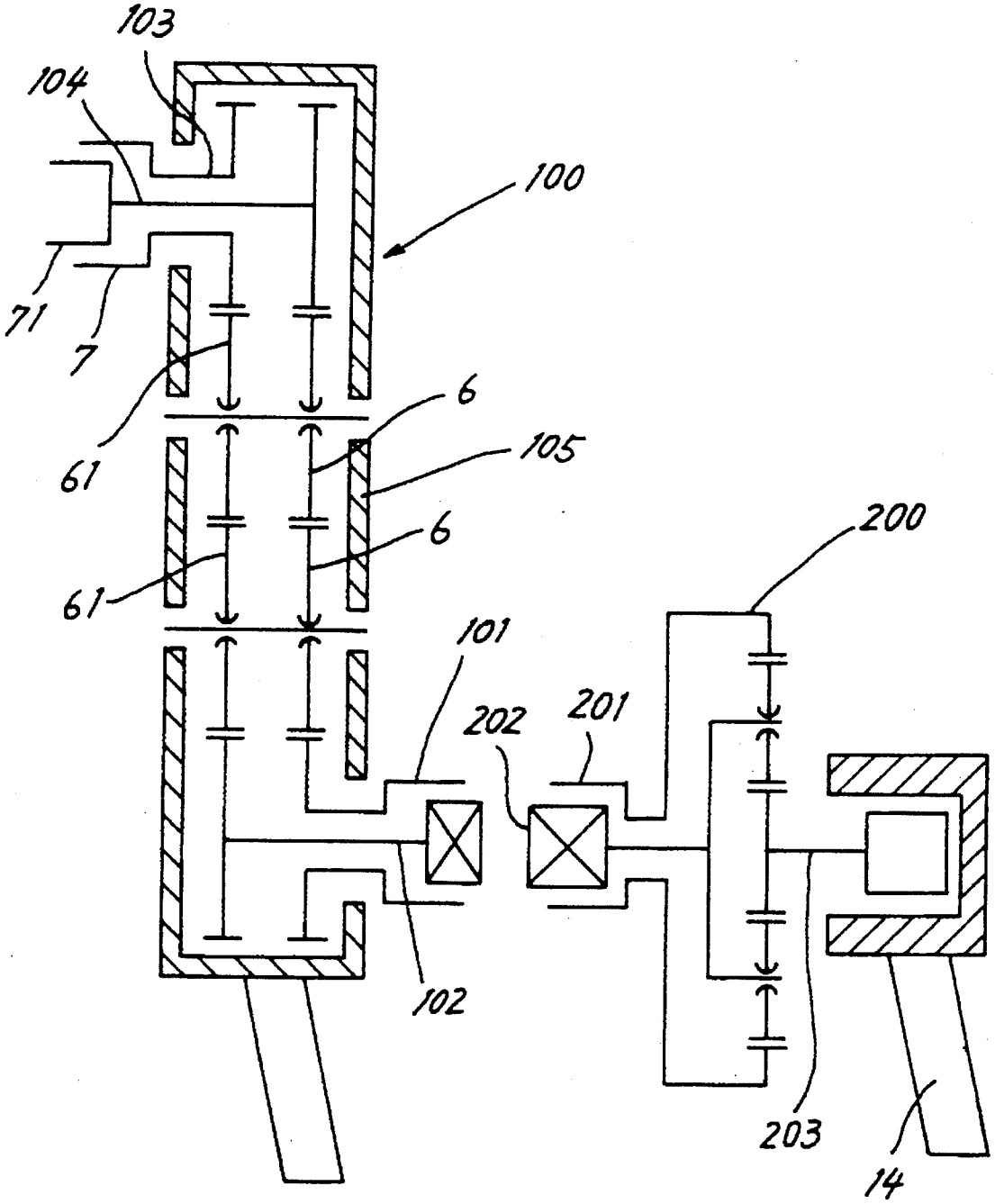
FIG. 3 PRIOR ART
FIG. 3 is a diagram generally illustrating a bolt tightening auxiliary tool previously proposed by the present applicants.
Figure 4:
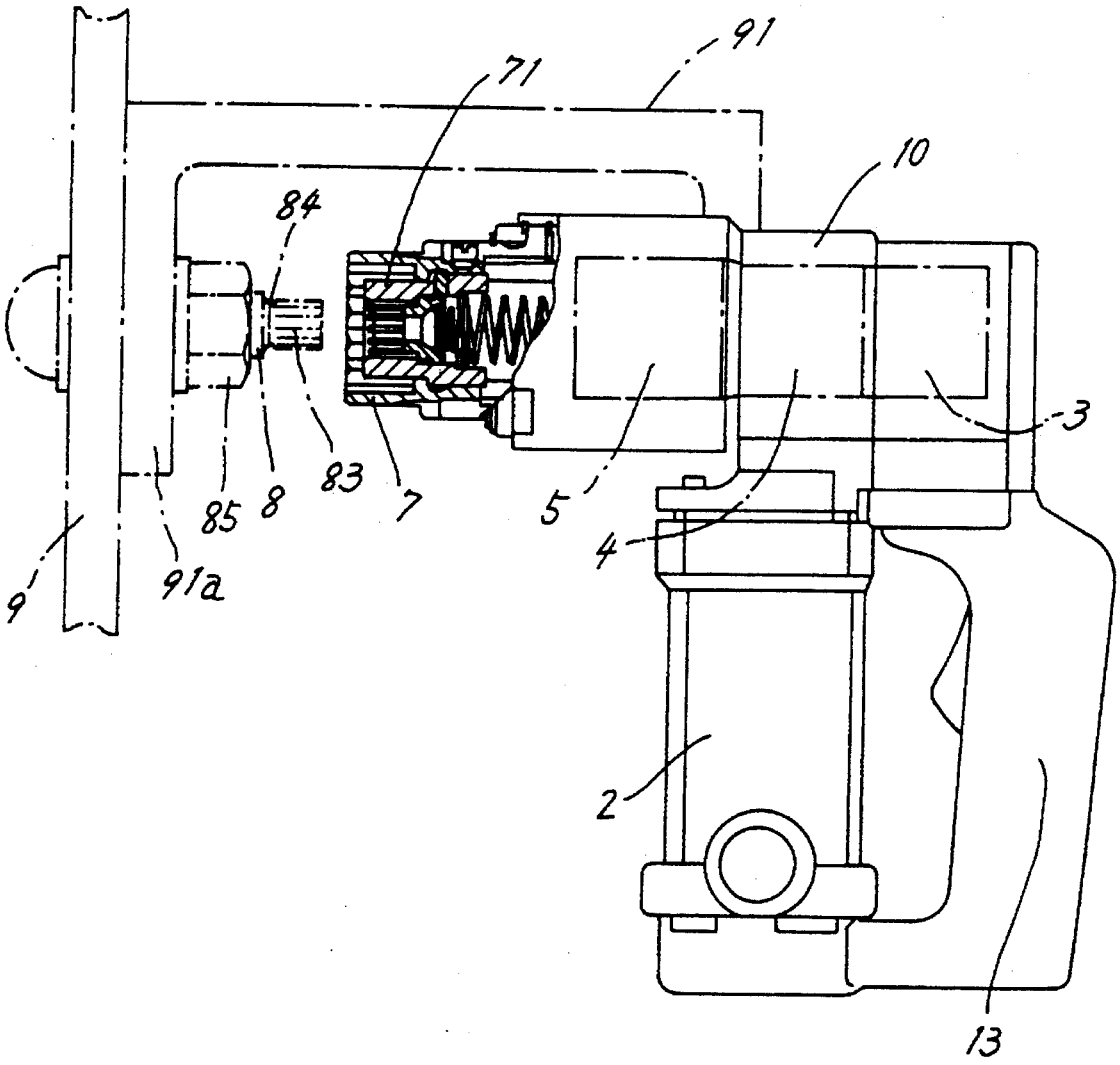
FIG. 4 PRIOR ART
FIG. 4 is a diagram illustrating a conventional bolt tightening device.

Next with reference to FIG. 2, paths of transmission of rotation from the motor 2 to the outer socket 7 and inner socket 71 will be described.

A drive gear 21 connected to the motor 2 is coupled to a sun gear 31 of the first planetary gear mechanism 3 via a gear train 22.

A support frame 34 supporting a planetary gear 32 of the first planetary gear mechanism 3 is connected to a sun gear 41 of the second planetary gear mechanism 4.

An internally toothed gear 33 of the first gear mechanism 3 and an internally toothed gear 43 of the second gear mechanism 4 are formed on a common rotary cylinder 35.

The cylinder 35 is formed on the outer periphery of one end thereof with an externally toothed gear 45 meshing with the idle gear 6.

An externally toothed gear 46 is connected to a support frame 44 supporting a planetary gear 42 of the second gear mechanism 4. The other idle gear 61 is in mesh with the gear 46.

The idle gear 6 is in mesh with an externally toothed gear 55 connected to a sun gear 51 of the third gear mechanism 5.

The other idle gear 61 is in mesh with an externally toothed gear 56 projecting from, and rotatable with, an internally toothed gear 53 of the third gear mechanism 5.

The inner socket 71 is coupled to a support frame 54 supporting a planetary gear 52 of the third gear mechanism 5. The outer socket 7 is coupled to the externally toothed gear 56.

The inner socket 71 is axially slidable relative to the support frame 54, rotatable with the support frame 54 and biased outward by a spring (not shown).

As seen in FIG. 1, the embodiment has a tip knockout pin 57 extending through the sun gear 51 and planetary gear support frame 54 of the third gear mechanism 5 and the inner socket 71. A tip twisted off from a bolt and remaining in the inner socket 71 when the bolt is tightened up can be forced out by the knockout pin 57.

A tip discharge passage (not shown) extending through the inner socket 71, support frame 54, sun gear 51 and rear wall of the housing extension 12 can be formed for discharging tips rearward one after another.

The torque of the motor 2 is transmitted to the sun gear 31 of the first planetary gear mechanism 3 and then delivered to the externally toothed gear 45 on the internally toothed gear 43 of the second planetary gear mechanism 4 and to the support frame 44 of the mechanism 4 as torques which are opposite to each other in direction. By way of the two idle gears 6, 61, the torques are delivered to the sun gear 51 of the third planetary gear mechanism 5 and to the externally toothed gear 56 on the internally toothed gear 53 of the mechanism 5 and output to the inner socket 71 and the outer socket 7 as torques of opposite directions.

Thus, the inner socket 71 and the outer socket 7 are coupled to the two output shafts of the planetary gear mechanism 5 in the terminal stage which are rotatable in directions opposite to each other, and the two output shafts of the second planetary gear mechanism 4 are coupled to the respective two input shafts of the terminal gear mechanism 5 by way of the idle gears 6, 61.

The second gear mechanism 4 is coupled to the third gear mechanism 5 by the idle gears 6, 61. This displaces the axis of the first and second gear mechanisms 3, 4 from the axis of the third gear mechanism 5 and the two sockets 7, 71 in parallel thereto. Accordingly, the socket side of the bolt tightening device can be diminished in axial dimension, permitting its sockets to be inserted even into the narrow groove of the channel member 91 for tightening up bolts on the member 91.

Planetary gear mechanisms are singly capable of multiplying a torque about four times easily, so that the idle gear used in the present invention can be reduced in width to ¼ of an idle gear for transmitting a great torque for tightening up bolt-and-nut fasteners if the gears are the same in the number of teeth and module. Thus the idle gear can be of reduced size.

Further since the terminal gear mechanism 5 at the socket side needs only to be meshable with such idle gears of reduced width, the gear mechanism 5 is not very great in axial dimension.

The reduction in the size of the idle gear also diminishes the shaft supporting this gear and the portion supporting the shaft, reducing the weight of the overall tightening device for an improved work efficiency.

When to be practiced, the present invention can be modified variously within the scope set forth in the appended claims. For example, a pair or pairs of additional idle gears can be interposed between the third planetary gear mechanism 5 and the idle gears 6, 61.

What is claimed is:

1. A bolt tightening device having an inner socket and an outer socket arranged coaxially with each other and coupled to a motor by a plurality of planetary gear mechanisms for tightening a reaction-bearing bolt with a nut screwed thereon by engaging the nut in the outer socket and a tip at one end of the bolt in the inner socket, the plurality of planetary gear mechanisms including a terminal planetary gear stage, the device being characterized in that the inner socket and the outer socket are coupled respectively to two output shafts of the terminal planetary gear stage rotatable in directions opposite to each other, the terminal planetary gear stage having an axis displaced from the axes of the other planetary gear mechanisms and in parallel thereto, the terminal planetary gear stage having two input shafts coupled to two output shafts of the other planetary gear mechanisms by way of first and second idle gears respectively.

2. A bolt tightening device as defined in claim 1 wherein the plurality of planetary gear mechanisms includes first and second planetary gear mechanisms, the first planetary gear mechanism being coaxial with the second planetary gear mechanism.

3. A bolt tightening device as defined in claim 2 further including an internally toothed gear of the first planetary gear mechanism and an internally toothed gear of the second planetary gear mechanism formed on a common rotary cylinder, the rotary cylinder having, on the outer periphery of one end thereof, a first externally toothed gear meshing with the first idle gear, and the device further including a second externally toothed gear connected to a sun gear of the terminal planetary gear stage, the second externally toothed gear meshing with the first idle gear.

4. A bolt tightening device as defined in claim 2 further including a third externally toothed gear connected to a support frame supporting a planetary gear of the second planetary gear mechanism and meshing with the second idle gear, and the device further including a fourth externally toothed gear projecting from an internally toothed gear of the terminal planetary gear stage and rotatable with the internally toothed gear of the terminal planetary gear stage and in mesh with the second idle gear.

* * * * *